US006536721B1

(12) United States Patent
Kao

(10) Patent No.: US 6,536,721 B1
(45) Date of Patent: Mar. 25, 2003

(54) REVOLVING SUPPORT STAND WITH ELECTRICAL POWER OUTLET

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 0 days.

(21) Appl. No.: 09/859,633

(22) Filed: May 18, 2001

(51) Int. Cl.[7] ..... A47F 5/02
(52) U.S. Cl. ..... 248/131; 248/522
(58) Field of Search ..... 248/131, 522, 248/519, 524, 521, 527, 528, 349.1

(56) References Cited

U.S. PATENT DOCUMENTS 2,674,147 A * 4/1954 Franklin ..... 84/95
3,042,350 A * 7/1962 Lencioni ..... 248/45
4,895,339 A * 1/1990 Yang et al. ..... 248/522
5,255,886 A * 10/1993 Wang ..... 248/522
5,647,569 A * 7/1997 Sofy ..... 248/522
5,713,554 A * 2/1998 Lai ..... 248/522
5,921,022 A * 7/1999 Baker ..... 47/40.5
6,320,327 B1 * 11/2001 Lavatelli et al. ..... 315/185 S

FOREIGN PATENT DOCUMENTS

GB 2272369 A * 5/1994 ..... 248/522

* cited by examiner

*Primary Examiner*—Leslie A. Braun
*Assistant Examiner*—A. Joseph Wujciak, III
(74) *Attorney, Agent, or Firm*—G. Brian Pingel; Camille L. Urban

(57) ABSTRACT

A revolving support stand for an ornamental display including a base having a housing and a trunk holder that is seated in a top opening of the base and includes an electrical outlet. An electrical motor is located in the base and provides a drive force to rotate the trunk holder with respect to the base.

8 Claims, 5 Drawing Sheets

REVOLVING SUPPORT STAND WITH ELECTRICAL POWER OUTLET

BACKGROUND OF THE INVENTION

1. Field of the Invention

The present invention relates to support stands that are designed to serve as a support for a decorative display such as a Christmas tree, and more specifically relates to a support stand that causes the decorative display to rotate in a circular fashion and has an electrical source of supply for the display.

2. Description of the Prior Art

Support stands for decorative displays such as Christmas trees have long been known and a variety of different embodiments of such stands are available. With respect to stands used to support decorative displays, such as Christmas trees, that include electrical lighting, the use of a stand that causes the display to rotate provides the problem of supplying electrical power to the lighting in a fashion that does not cause electrical cords to become wrapped around the display during its rotation.

The present invention is adapted to provide a revolving support stand for a decorative display that permits electrical power to be provided to the display during its rotation. This power supply is provided in a unique and efficient fashion so as to provide a source of electrical power that rotates in unison with the display.

SUMMARY OF THE INVENTION

The present invention provides a revolving stand to support the trunk of a decorative display for circular rotation and includes a base, a trunk holder associated with the base, an electrical motor for rotating the trunk holder, an electrical outlet associated with an upper end of the trunk holder, and means for supplying electrical power from a power source to the electrical outlet while the trunk holder rotates with respect to the base.

Preferably, the trunk holder includes a bottom hub portion that is seated in a top opening in the base to project into a housing forming the base. Electrical contact means are located in the housing and the trunk holder includes conducting means for electrically connecting the outlet to the contact means. Gear means are associated with the motor and the trunk holder to provide rotational force on the holder when the motor is in an on condition, and conducting means are provided for providing electrical power to the motor and the contact means from a source of power, such as a normal electrical outlet of a building.

Preferably, the electrical conducting means includes a pair of contact rings mounted on the bottom of the hub portion of the trunk holder so that each of said rings engage one of the contact means in the housing and further includes an electrical conductor extending between the electrical outlet and said contact rings so that as the trunk holder rotates, a complete electrical circuit is maintained from the source for providing electrical power to the electrical outlet at the top of the trunk holder.

Other objects, features and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DETAILED DESCRIPTION OF THE PREFERRED EMBODIMENTS

Figure 1:
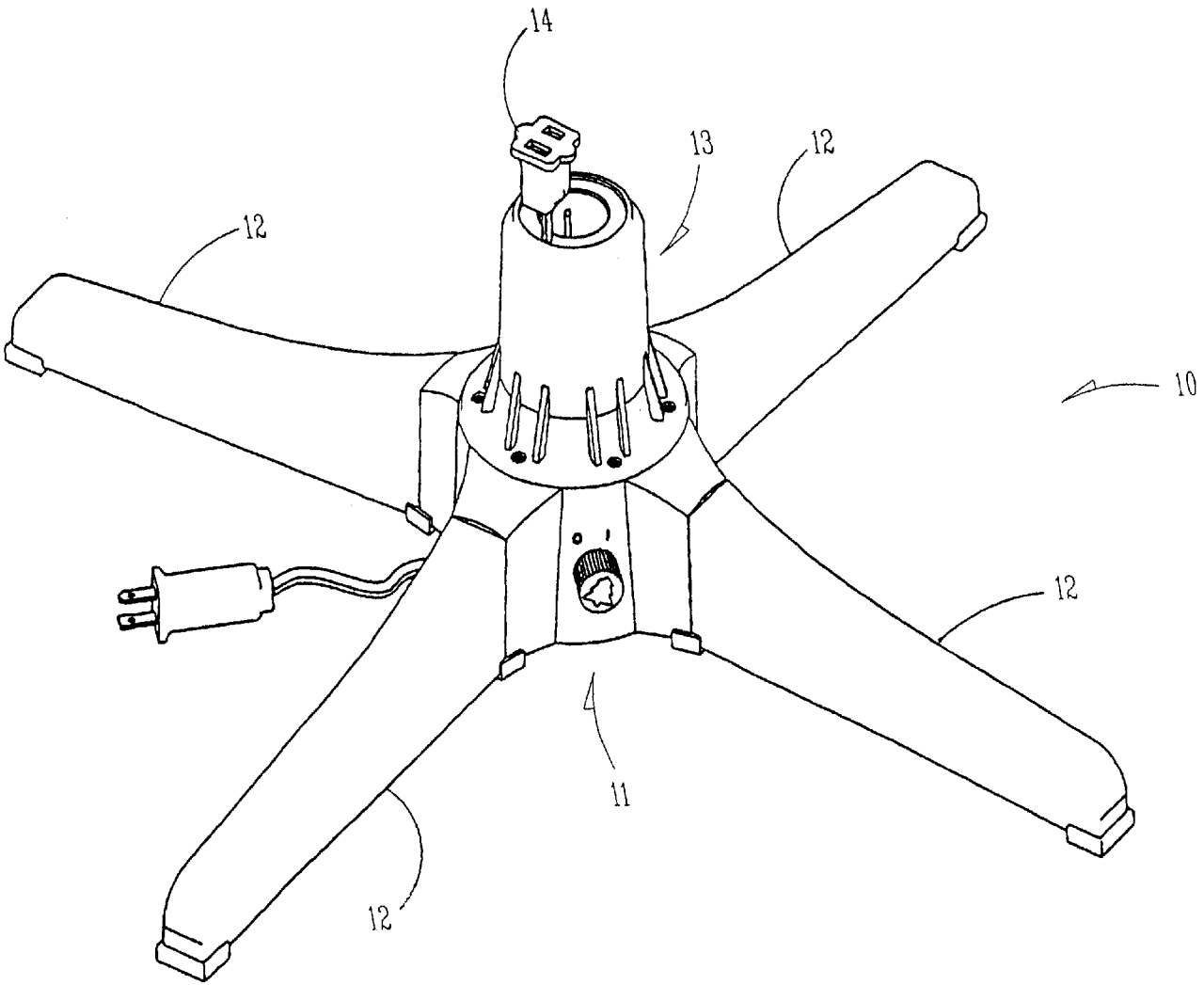
FIG. 1 is front perspective view of a preferred embodiment of a revolving support stand in accordance with the present invention.

Referring now to the drawings and with reference first to FIG. 1, a preferred embodiment of the revolving support stand of the present invention is shown generally at 10 and is adapted preferably for supporting the trunk of a decorative display such as a Christmas tree. The stand 10 includes a support base 11 that preferably includes four outwardly extending legs 12 spaced apart by ninety degrees and being removable from the remainder of the base. The base 11 serves as a support for a trunk holder 13 that includes an electrical outlet 14 at its upper end connected to a cord 15.

Figure 2:
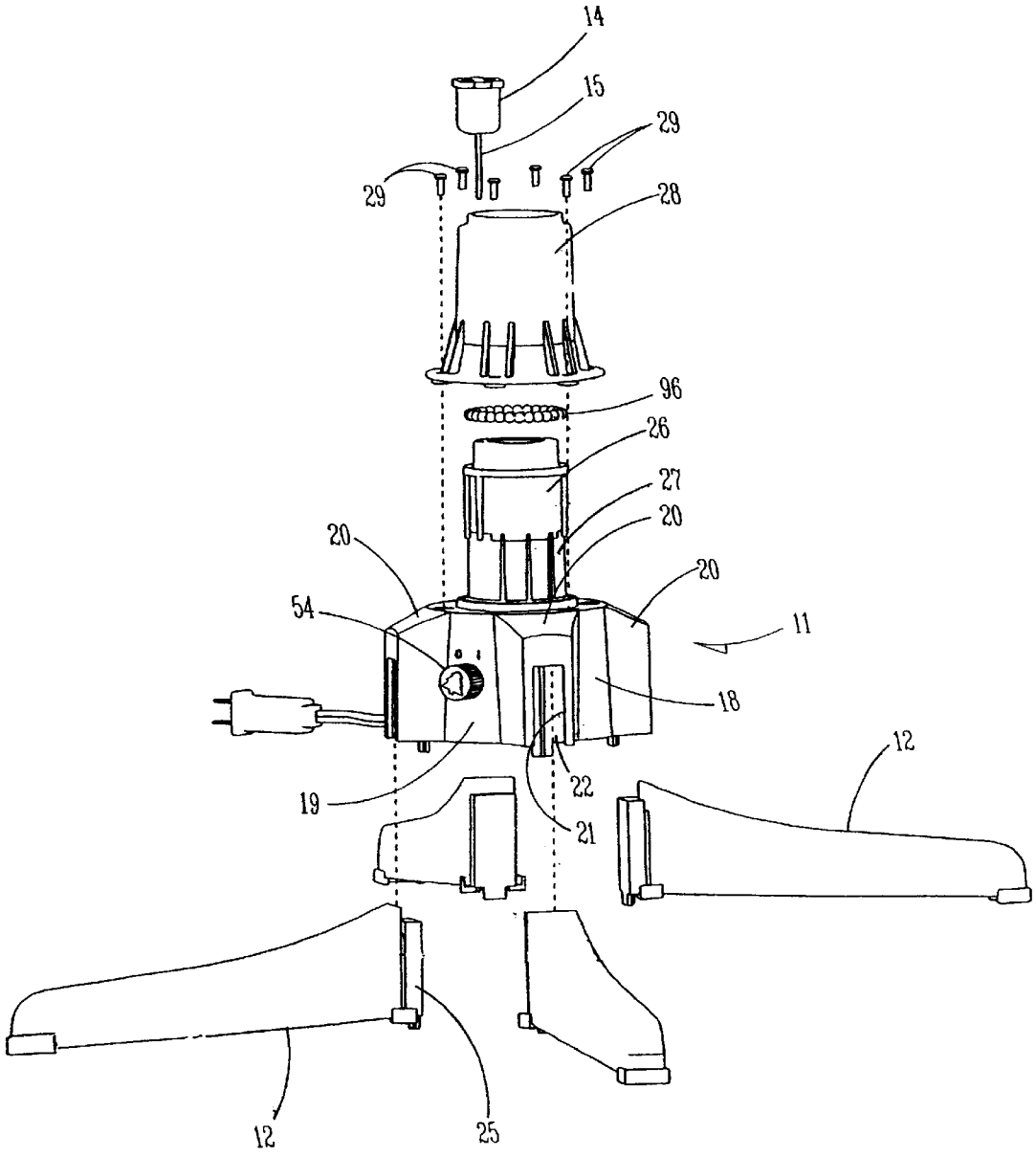
FIG. 2 is an exploded perspective view of the embodiment of FIG. 1 showing a base, legs for the base, a trunk holder and an enclosure shell of the stand of FIG. 1.

Referring now to FIG. 2, which is an exploded view of the stand 10, the base 11 is shown as including a housing 18 with a sidewall 19 having four equally spaced apart shoulder type projections 20. Each of the projections 20 include a channel 21 with an open bottom end 22. A connecting post 25 is integrally formed on the inner end of each of the legs 12 and conforms in shape to that of one of the channels 21 so that the leg posts 25 are insertable into the channels 21 for removably attaching the legs 12 to the base 11.

The trunk holder 13 is formed in two parts, with an upper section 26 and a lower section 27 having opposing ends that mate with one another as will be more fully described below. The upper portion of the stand 10 is capped off with an enclosure shell 28 that is adapted to enclose the trunk holder 13 and is attachable to the top of the base 11 as by screws 29 to secure the trunk holder 13 in a vertically extending position with respect to to the base 11.

Figure 3:
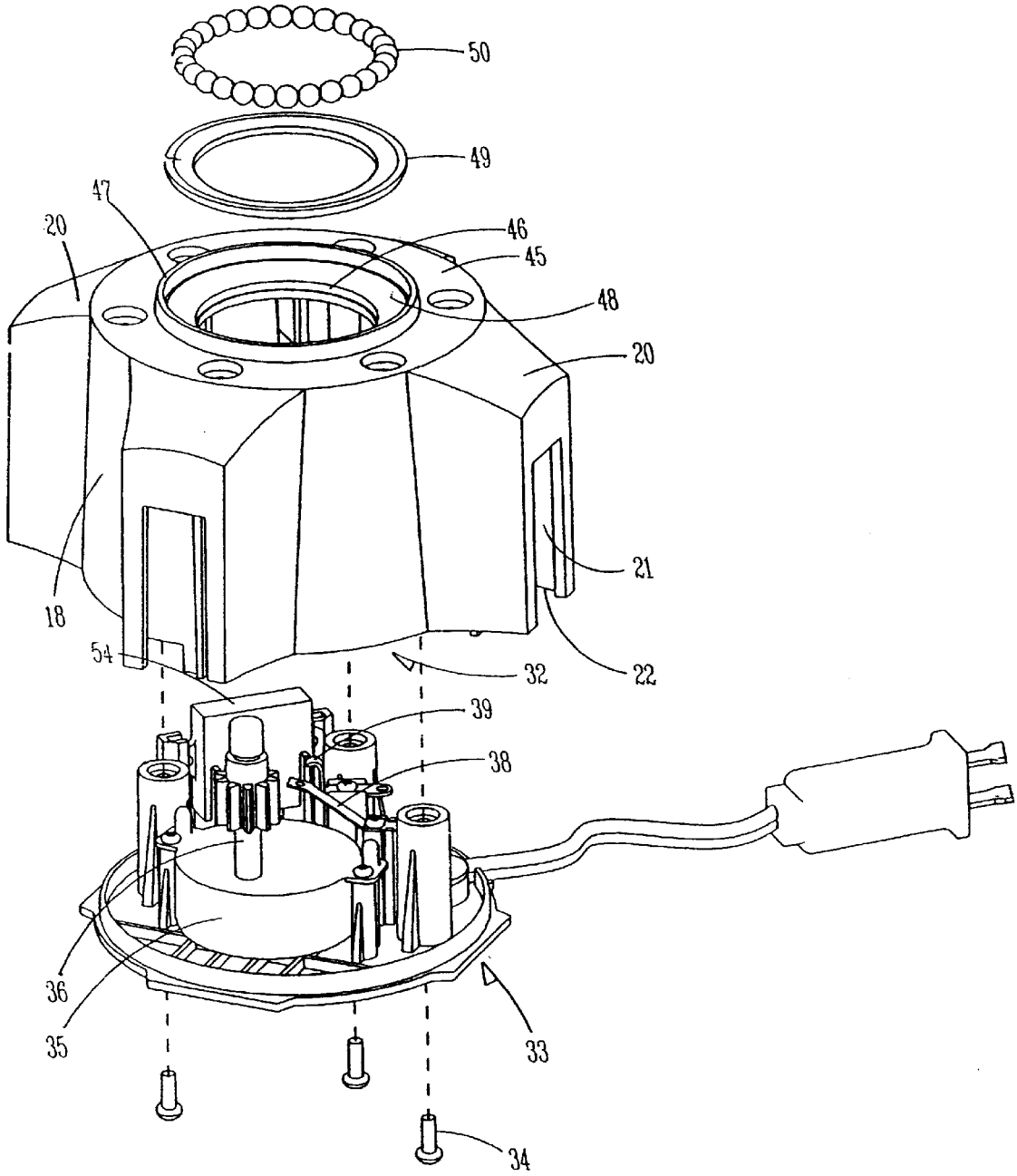
FIG. 3 is an enlarged, exploded, perspective view of the base of FIG. 2 and showing certain of the electrical components contained therein.

Referring now to FIG. 3, the housing 18 has an open lower end 32 that is closed off by a floor plate 33 attachable to the housing 18 as by screws 34 or the like. The electrical drive components for the stand 10 are secured to the top surface of the plate 33 and include a motor 35 with an output shaft 36, a pinion gear 37 mounted on the shaft 36 and a flexible spring contact 38 and a spring loaded contact 39. Electrical power is supplied to these elements by a cord 40 with an end plug 41 that can be inserted into any normal electrical outlet of a building.

The housing 18 further includes an upper end 45 with a relatively large central opening 46. A circular flange 47 borders the opening 46 and extends upwardly from the end 45 to provide a seat 48 for a bearing race 49 in which a plurality of steel balls sit to serve as a truss bearing to overcome the axial load applied on the housing 18 by the ornamental display supported by the stand 10.

Figure 4:
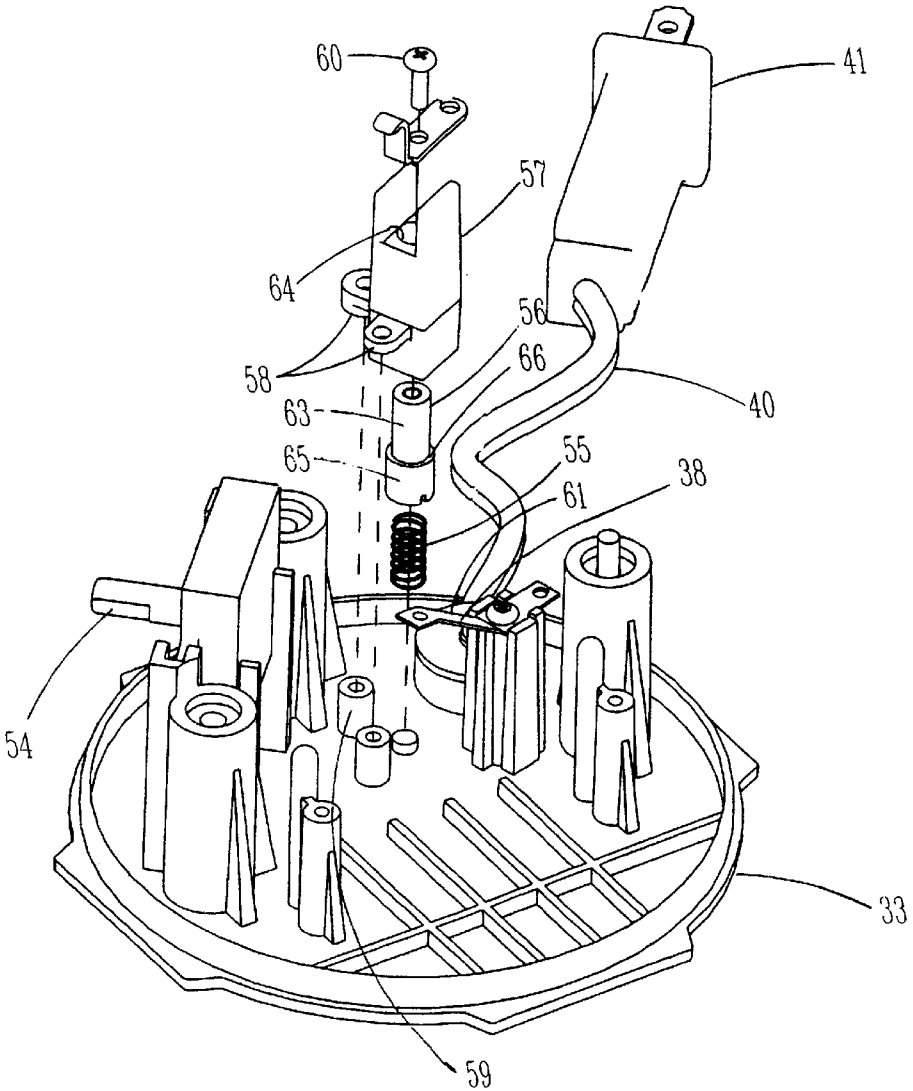
FIG. 4 is an enlarged, partially exploded, perspective view of the electrical components of the base of FIG. 3.

As best shown in FIG. 4, the electrical components on the floor plate 33 also include a power switch 54 that controls the operation of the motor 35, which has been removed from the plate 33 in this view to better expose the remaining components located thereon. The electrical contact 39 is spring loaded to provide it with an upwardly directed bias. The support structure for the contact 39 is shown in an exploded arrangement in FIG. 4 and consists of a coil spring 55, a spring housing 56 and an outer support member 57 that encloses the spring housing 56 and has ears 58 securable to two posts 59 on the floor plate 33.

The spring housing 56 has a narrow upper end 63 that extends through an opening 64 in the support member 57 and an enlarged lower portion 65 with a ledge 66 that abuts against the circumference of the support member opening 64 to maintain the spring housing 56 within the member 57, but still permitting vertical movement of the spring housing with respect to the member 57. The electrical contact 38 is secured to the top of the spring housing 56 by a screw 60 or the like. Thus, the contact 38 is biased upwardly by the spring 55. The flexible spring contact 38 and the spring loaded contact 39 are connected to the power cord 40 via a strain relief disk 61 to act as one part of an electrical circuit for the decorative display supported by the stand 10.

Figure 5:
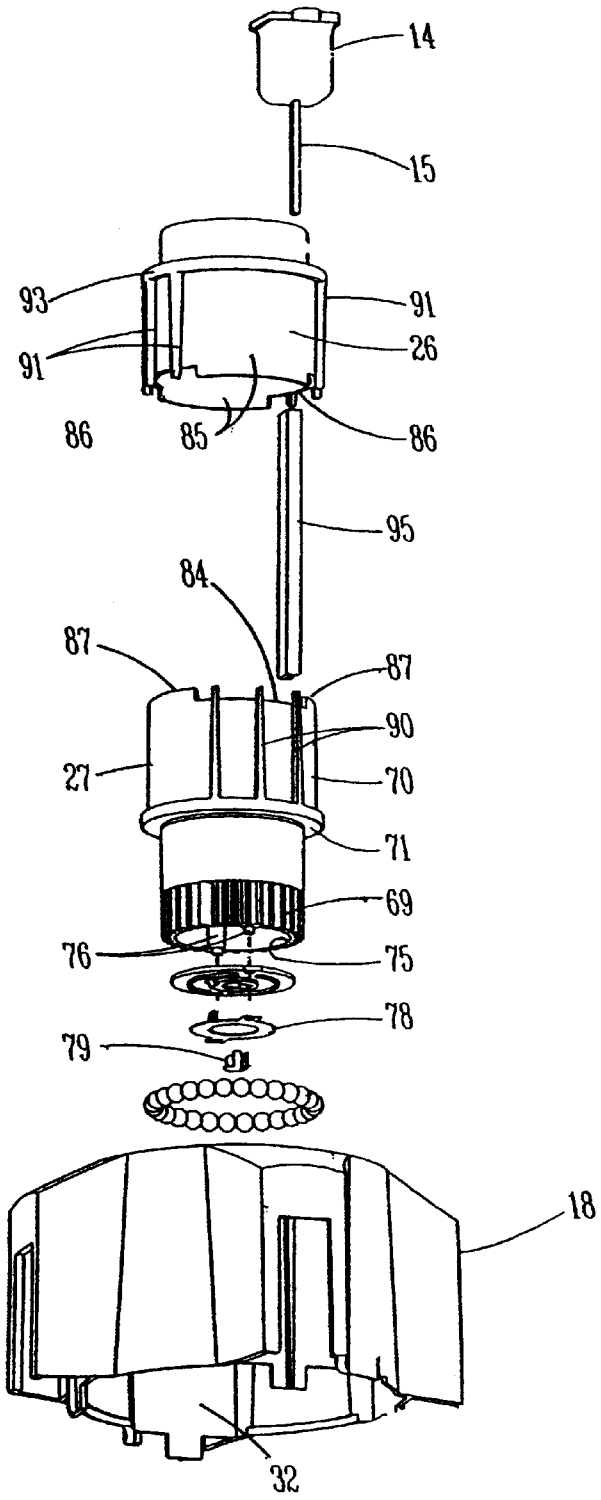
FIG. 5 is an exploded, perspective view of the base and the trunk holder of FIG. 2.

Turning now to FIG. 5, the trunk holder 13 is shown in exploded fashion in relationship to the base housing 18. The lower section 27 of the trunk holder 13 is formed with a lower hub portion 68 having circumferential gear teeth 69 on its bottom end. The lower section 27 further includes a top portion 70, and both portions 69 and 70 are tubular in shape. However, the top portion 70 is larger than the hub portion 69 to provide a shoulder 71 that sits upon and is supported by the steel balls 50. The bottom end of the hub portion 68 includes an opening 75 through which support posts 76 extend for attachment of a connector plate 77 to which copper contact rings 78 and 79 are attached to engage the electrical contacts 38 and 39 in the base 11 when the trunk holder is inserted therein.

The top end of the section 27 is notched as at 84 for receiving conforming tongue members 85 extending from the bottom end of the section 26. Likewise, the section 26 has notches 86 that conform to tongue members 87 on the section 27. Thus, when the sections 26 and 27 are assembled together, the notch and tongue elements of such sections mate together. Vertically extending fingers 90 on the lower section 27 and similar type fingers 91 on the upper section 26 serve to keep the sections 26 and 27 aligned with one another and also provide a clutch construction so that when rotational force is applied to the lower section 26, it will be transmitted to the upper section 27.

The upper section 26 includes a neck portion 92 to provide a shoulder 93 which is engaged by the enclosure shell 28 when it is secured on top of the trunk holder 13 to secure the trunk holder 13 to the base 11. A vertically oriented conduit member 95 is located within the trunk holder 13 to provide a channel through which the cord 15 for the electrical outlet 14 is disposed, which cord 15 is electrically connected to the contact rings 78 and 79 to complete the electrical circuitry from the plug 41 to the outlet 14.

As indicated in FIG. 2, it is highly preferable to utilize steel balls 96 that are located on the shoulder portion 93 of the trunk holder 13 to serve as a bearing between the trunk holder 13 and the enclosure shell 28. The steel balls 96 serve to overcome radial loads and to provide a bearing engagement between the shell 28 and the holder 13 as there is rotational motion of the holder 13 relative to the shell 28.

Thus, the present invention provides a durable and efficient support for displaying a decorative display in a rotational fashion that permits the use of electrical lights on the display. The foregoing description of the present invention is solely for illustrative purposes only. It is to be understood that the terminology that has been used in intended to be in the nature of words of description rather than of limitation. Many modifications and variations of the present invention are possible in light of the above teachings. For example, there are many different alternatives for providing the electrical circuitry necessary for the present invention and the particular circuitry disclosed would be known by those skilled in the art as being only one example of the type of circuitry that could be utilized in the present invention. Therefore, the foregoing description is not to be taken as definitive of the scope of the invention; but rather that which is regarded as the invention is set forth in the following claims.

What is claimed is:

1. A revolving stand to support the trunk of a decorative display for circular rotation, said stand comprising:

(a) a base having a housing with a top that has an opening;

(b) an electrical motor located in said housing;

(c) a pair of electrical contacts located in said housing wherein at least one of said pair of electrical contacts is spring-loaded;

(d) a source of electrical power for said motor and said contacts;

(e) a trunk holder with a bottom hub portion that is seated in said opening of said base and projects into said housing and a top portion for receiving the trunk of said display wherein said top portion comprises an upper section and a lower section, each having a body portion that includes a free end and spaced apart exterior fingers whereby the fingers of one section are engagable with the fingers of the other section so as to serve as a drive clutch assembly;

(f) gear means associated with said motor and said holder to cause rotation of said holder with respect to said base when said motor is in an on condition;

(g) electrical conducting means for connecting electrical power to said outlet;

(h) said electrical conducting means comprising a pair of contact rings mounted on the bottom of said hub portion so that each of said rings engages one of said pair of electrical contacts; and (i) an electrical power outlet associated with the upper end of said trunk holder.

2. A revolving stand as described in claim 1, wherein said base further includes a floor plate that is secured to said housing.

3. A revolving stand as described in claim 2, wherein said base further includes at least three legs that project outwardly from said housing.

4. A revolving stand as described in claim 3, wherein said legs are detachably connected to said housing.

5. A revolving stand as described in claim 1, further including an electrical conductor extending between said electrical outlet and said contact rings.

6. A revolving stand as described in claim 1, wherein said gear means include an output shaft on said motor, a pinion gear attached to said output shaft and gear teeth formed on the exterior of the hub portion of said trunk holder.

7. A revolving stand as described in claims 1, wherein said stand further includes a generally tubular shaped enclosure shell adapted to fit around said trunk holder to secure said trunk holder to said base in a fashion that permits the trunk holder to rotate with respect to the base.

8. A revolving stand to support the trunk of a decorative display for circular rotation, said stand comprising:

a) a base having a housing with a top;

b) an electrical motor located in said housing;

c) a pair of spring-loaded electrical contacts;

d) a trunk holder with a bottom hub portion that is seated in said base and projects into said housing and a top portion for receiving the trunk of said display which further comprises an upper section and a lower section separable from one another, each said section having at least one open end that mates with one open end of the other section and each section includes spaced apart exterior fingers whereby the fingers of one said section engage with the fingers of the other said section to serve as a drive clutch assembly;

e) electrical conducting means for providing electrical poser to an outlet located at said top of said housing said electrical conducting means comprising a pair of contact rings mounted on the bottom of said hub portion so that each of said rings engages one of said spring-loaded electrical contacts;

f) gear means associated with said motor and said trunk holder to cause rotation of said holder with respect to said base when said motor is in an on condition.

* * * * *